US008704723B2

(12) United States Patent
Bourtoutian et al.

(10) Patent No.: US 8,704,723 B2
(45) Date of Patent: Apr. 22, 2014

(54) DIFFERENTIAL DIPOLE ANTENNA SYSTEM WITH A COPLANAR RADIATING STRUCTURE AND TRANSCEIVER DEVICE

(75) Inventors: Raffi Bourtoutian, Grenoble Cedex 9 (FR); Christophe Delaveaud, Saint Jean de Moirans (FR)

(73) Assignee: Commissariat a l'Energie Atomique et aux Energies Alternatives, Paris (FR)

( * ) Notice: Subject to any disclaimer, the term of this patent is extended or adjusted under 35 U.S.C. 154(b) by 413 days.

(21) Appl. No.: 13/127,815

(22) PCT Filed: Nov. 7, 2008

(86) PCT No.: PCT/FR2008/001573

§ 371 (c)(1), (2), (4) Date: May 5, 2011

(87) PCT Pub. No.: WO2010/052377

PCT Pub. Date: May 14, 2010

(65) Prior Publication Data

US 2011/0248899 A1 Oct. 13, 2011

(51) Int. Cl.
*H01Q 9/28* (2006.01)

(52) U.S. Cl.
USPC ..... 343/795; 343/895

(58) Field of Classification Search
USPC ..... 343/795, 895, 700 MS
See application file for complete search history.

(56) References Cited

U.S. PATENT DOCUMENTS

| | | | | |
|---|---|---|---|---|
| 8,284,001 | B2 * | 10/2012 | Bourtoutian | 333/204 |
| 8,446,331 | B2 * | 5/2013 | Johnson | 343/803 |
| 2001/0054943 | A1 | 12/2001 | Takeda | |
| 2005/0162240 | A1 | 7/2005 | Saitou et al. | |
| 2007/0126533 | A1 | 6/2007 | Saitou et al. | |
| 2011/0090131 | A1 * | 4/2011 | Chen et al. | 343/815 |

OTHER PUBLICATIONS

International Search Report issued Aug. 4, 2009 in PCT/FR08/01573 filed Nov. 7, 2008.

* cited by examiner

*Primary Examiner* — Ahshik Kim
(74) *Attorney, Agent, or Firm* — Oblon, Spivak, McClelland, Maier & Neustadt, L.L.P.

(57) ABSTRACT

A differential dipole antenna system includes, on a same surface of a dielectric substrate, a first half of a thick radiating dipole, a first conducting strip of a bi-strip line for supplying a differential signal, the first conducting strip being connected to the first half of the thick radiating dipole, a second half of a thick radiating dipole and a second conducting strip of the bi-strip supply line, the second conducting strip being connected to the second half of the thick radiating dipole. The system further includes, on the same surface, an additional conducting strip defining a short circuit connecting the first half and the second half of the thick dipole, and a differential resonating filtering device having a bandwidth adapted so as to be combined with the resonance generated by the short circuit so as to generate an antenna impedance matching.

10 Claims, 7 Drawing Sheets

Fig.8
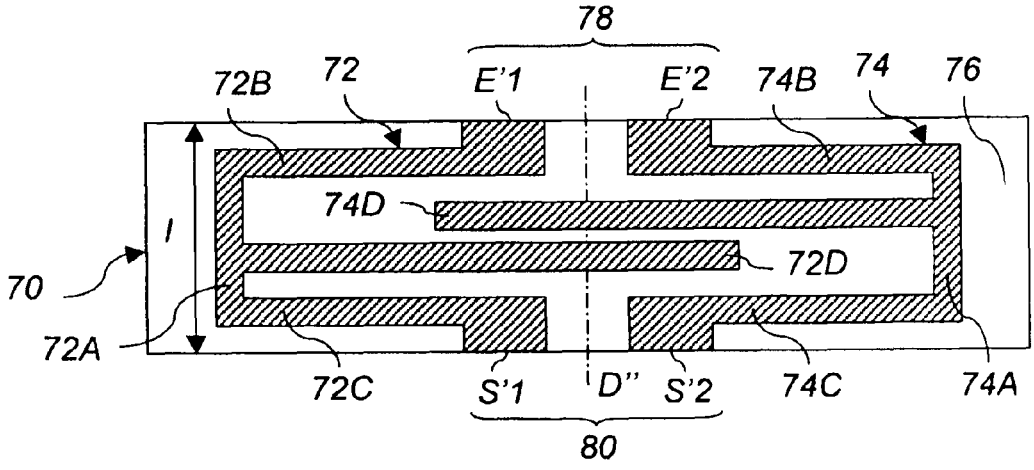
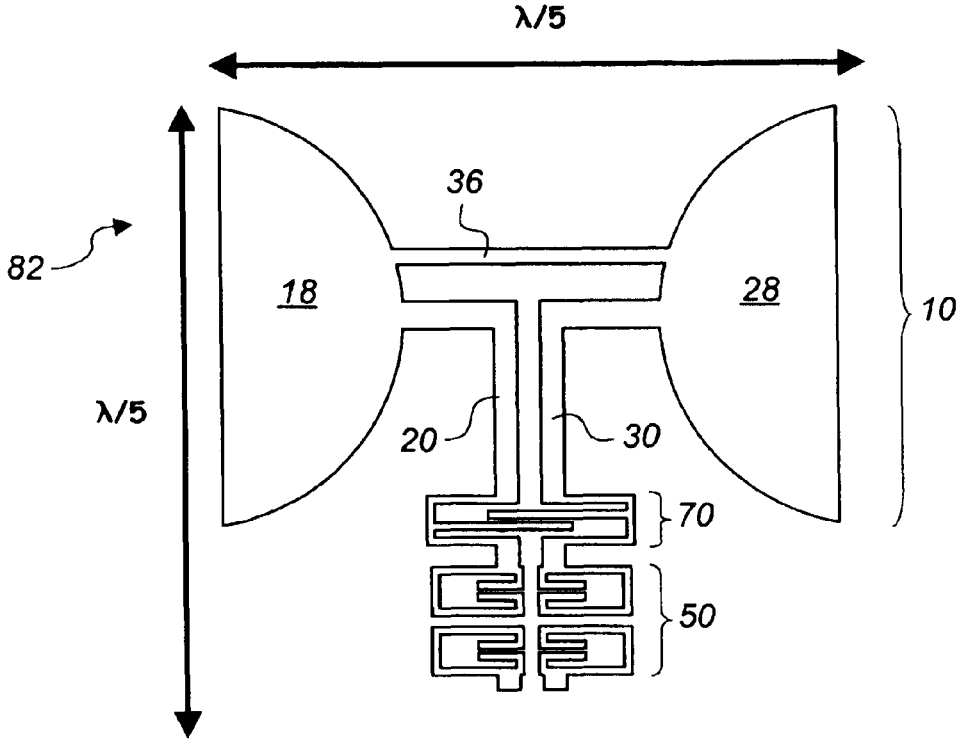
Fig.9

Fig.12
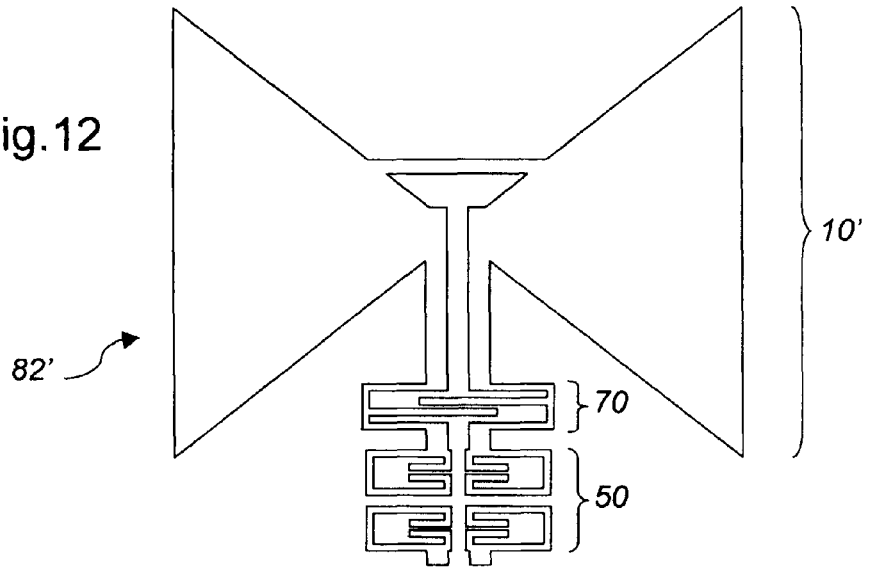
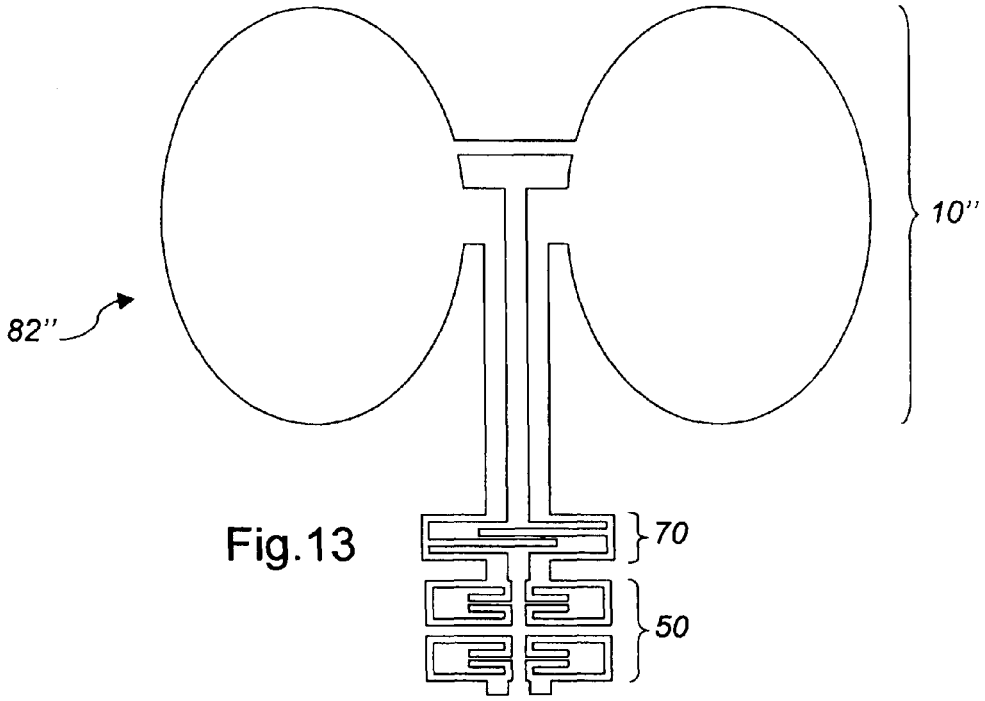
Fig.13

DIFFERENTIAL DIPOLE ANTENNA SYSTEM WITH A COPLANAR RADIATING STRUCTURE AND TRANSCEIVER DEVICE

BACKGROUND OF THE INVENTION

1. Field of the Invention

The present invention relates to a differential dipole antenna system adapted for applications of transmission/reception of differential signals with wide bandwidth. It also relates to a corresponding transmission and/or reception device.

2. Discussion of the Background

Radiofrequency transmission/reception systems supplied by differential electrical signals are very attractive for present and future wireless communications systems, particularly for concepts of autonomous communicating objects. A differential supply is a supply by two signals of equal amplitude in phase opposition. It contributes to reducing, or even eliminating, the noise known as "common mode noise", undesirable in transmission and reception systems.

In the field of mobile telephony for example, when a non differential system is used, a significant degradation of the radiation performance is indeed observed when the operator holds a handset provided with such a system. This degradation is caused by the variation, due to the hand of the operator, of the distribution of current on the frame of the handset used as ground plane. The use of a differential supply makes the system symmetrical and thus reduces the concentration of current on the casing of the handset: it thus renders the handset less sensitive to common mode noise introduced by the hand of the operator.

In the field of antennas, a non differential supply leads to undesirable radiation of a crossed component due to the common mode circulating in the non symmetrical supply cables. The use of a differential supply eliminates crossed radiation from the measurement cables and thus makes it possible to obtain reproducible measurements, independent of the measurement context as well as perfectly symmetrical radiation diagrams.

In the field of active components, power amplifiers of "push-pull" type, the structure of which is differential, have several advantages, such as dividing in two the output power and the elimination of higher order harmonics. In reception, low noise differential amplifiers have several perspectives in terms of reduction of the noise factor. Also, the use of a differential structure prevents the undesirable triggering of oscillators by common mode noise.

The electrical dipole antenna is the differential antenna that may be envisaged the most naturally. It is an antenna constituted of two identical and symmetrical arms, supplied by two signals of equal amplitude and in phase opposition. Recently, thick dipoles known for their wide bandwidths have been widely used for high speed communications, in accordance with the different UWB (Ultra Wide Band) communication standards aimed at communications with wide bandwidths. When they are used in non symmetrical devices, these antennas show problems of common mode noise, the differential supply of which makes it possible to overcome.

For reasons of optimisation of their size, these antennas are moreover advantageously formed using coplanar technology, particularly using differential CPS (CoPlanar Stripline) technology. Furthermore, differential CPS technology makes it possible to benefit from the advantages of differential structures while enabling simple coplanar integration with discrete constituents: it is not necessary to create via type connections to link the constituents together. The absence of ground plane also makes it possible to envisage a simple connection, less perturbing with other differential coplanar constituents. Consequently, more and more differential devices are designed according to this technology.

The invention thus more specifically relates to an antenna that comprises, on a same surface of a dielectric substrate, a first half of a thick radiating dipole, a first conducting strip of a bi-strip line for supplying a differential signal, the first conducting strip being connected to the first half of the thick radiating dipole, a second half of a thick radiating dipole and a second conducting strip of the bi-strip supply line, said second conducting strip being connected to the second half of the thick radiating dipole.

Such a differential dipole antenna is for example described in the document "Differential and single ended elliptical antennas for 3.1-10.6 GHz ultra wideband communication", of Powell et al., IEEE Antennas and Propagation Society International Symposium Proceedings, vol. 3, pages 2935-2938 (2004). In this document, the thick dipole comprises two radiating halves of elliptic shape supplied by a differential bi-strip line. It ensures operation in a range of frequencies ranging from 3.1 to 10.6 GHz for UWB type applications. In particular, the WiMedia UWB standard allocates bandwidths between 4.2 and 4.8 GHz in Europe, to ensure compatibility with American standards. An elliptic differential dipole antenna of this type is also described in the document "Planar elliptical element ultra-wideband dipole antenna", of Schantz, IEEE Antennas and Propagation Society International Symposium Proceedings, vol. 3, pages 44-47 (2002).

In the document "A novel CPS-fed balanced wideband dipole for ultra-wideband applications", of Chan et al., Proceedings of the European Conference on Antennas and Propagation, EuCAP 2006, pages 235.1 (2006), the thick dipole comprises two radiating halves of half disc shape supplied by two conducting strips of a differential bi-strip line.

More generally, "thick dipole" is taken to mean any dipole in which the radiating halves occupy a compact geometric surface, such as a polygon (in particular a triangle), an ellipse, a disc, a half ellipse or a half disc.

It may also be noted that the more a dipole antenna is thick and has slow transition of field lines between its arms, the more it has a wide bandwidth. Several geometric shapes make it possible to attain more or less wide bandwidths. For example, a "butterfly" type antenna, the arms of which are of triangular shape, has a relative bandwidth, defined by the relation $\Delta f/f_0$ where $\Delta f$ is the width of the bandwidth and $f_0$ the central operating frequency of the antenna, of the order of 20%. An elliptic antenna may, in certain cases, have a relative bandwidth exceeding 100%.

The aforementioned antennas are quite compact and with wide bandwidth but they generally have the dimension of a half wave at the low operating frequency, i.e. 30 to 40 mm at 4 GHz. In numerous applications where a very high miniaturisation is required, they remain however too bulky. In particular, applications generally targeted are those using USB wireless type communication protocols, on USB cards of very small sizes for which the dimensions cited above are not suitable.

Unfortunately, most of the known conventional miniaturisation techniques are not valid for coplanar differential symmetrical structures. Furthermore, the laws of physics and electromagnetism provide a reduction in bandwidth with the reduction in the size of the antennas, which is not desirable, particularly in the aforementioned applications.

Furthermore, an antenna must generally be connected to a band pass filtering device. Indeed, an antenna is a device that transmits and receives electromagnetic power. A band pass filter is then used to limit the frequency band in which the antenna is going to transmit or receive electromagnetic signals. This makes it possible to reduce the noise captured out of band and to prevent interference of signals transmitted or received by the antenna with signals transmitted by other communications systems operating on other sometimes neighbouring frequency bands.

In a conventional manner, filters manufactured independently are connected to the antennas. This requires in most cases the use of matching circuits or instead long transitions, costly in terms of size and losses added to the overall system.

To reduce the dimensions of a filtering antenna system and improve its efficiency, the European patent application published under the number EP 1 548 872 provides forming a filtering antenna using multilayer technology. In this document, the radiating constituent of the antenna is placed on an upper layer and a coupled resonator filter is formed on a multiplicity of lower layers of the structure between the radiating structure and a ground plane. However, although compact, this filtering antenna has a narrow bandwidth on account of the use of a patch type antenna. In addition, its formation requires mastery of multilayer technology, which is quite costly and difficult to put in place.

In fact, few works have tackled the integration of an antenna and a filter using differential technology. However, the formation of an integrated set of filtering antenna using differential technology makes it possible to connect it directly to the active circuits, generally also formed using differential technology, and thus to do away with line-balance converter circuits (or baluns) which increase the cost and the size of a transmission/reception system and reduce its efficiency.

Such a differential wide band filtering antenna is nevertheless described in the document "Co-designed CPS UWB filter-antenna system" of Yang et al., IEEE Antennas Propagation International Symposium Proceedings, June 2007, pages 1433-1436. This filtering antenna is formed using differential CPS technology. In addition, the filtering device of this antenna ensures the impedance matching of the high impedance loop antenna used. This differential filtering antenna thus has several advantages, such as the elimination of impedance matching circuits and the elimination of baluns.

However, apart from the fact that the filtering device of this antenna ensures the impedance matching and the symmetrization of the loop antenna, there is not really any joint design of these two constituents since, neither the antenna which is an ordinary loop antenna, nor the filter which is formed by rectilinear conducting strips with impedance jump, are optimised in terms of size. Indeed, the filtering antenna assembly formed in this document occupies a large size, of the order of a guided wavelength, which makes it difficult to integrate it in current portable telecommunications systems.

SUMMARY OF THE INVENTION

In view of the aforementioned prior art, there exists a need for integration of band pass filters with miniature antennas to reduce the dimensions of a filtering antenna system. This strategy aiming to concentrate within a same component several functionalities, as it happens radiation and filtering, poses several difficulties, especially for new applications requiring structures with very wide band differential signals. Thus, according to this strategy, each constituent of the same component must be designed to ensure the optimal operation of the other constituents of the component while limiting the interconnections that reduce its overall performance while adding additional losses. It is also advisable to eliminate in this type of component certain bulky constituents such as baluns.

It may thus be desired to provide a differential dipole antenna system meeting this need for integration.

According to one aspect, the invention aims to make up for at least part of the aforementioned problems and constraints by providing a differential antenna system of optimised size using coplanar technology.

An object of the invention is thus a differential dipole antenna system, that comprises, on a same surface of a dielectric substrate, a first half of a thick radiating dipole, a first conducting strip of a bi-strip line for supplying a differential signal, said first conducting strip being connected to the first half of the thick radiating dipole, a second half of a thick radiating dipole and a second conducting strip of the bi-strip supply line, said second conducting strip being connected to the second half of the thick radiating dipole, the antenna system further comprising on said same surface an additional conducting strip defining a short circuit connecting the first half and the second half of the thick dipole, and a differential resonating filtering device, having a bandwidth adapted so as to be combined with the resonance generated by the short circuit so as to generate an antenna impedance matching.

It appears first of all that the addition of a short circuit between the two halves of a thick radiating dipole of the coplanar differential dipole antenna system makes it possible to obtain a significant reduction of its total surface. Indeed, the short circuit behaves like an impedance matching network and ensures a resonance at a frequency lower than the natural resonance frequency of the antenna. Thus, at constant size, the operating wavelengths increase. In other words, for a given upper operating wavelength, the size of the antenna system is significantly reduced to dimensions less than the apparent half wavelength.

But the use of a short circuited antenna in UWB applications may not seem to be able to be envisaged at first sight in so far as due to its high resonance it has a narrower bandwidth around the resonance frequency.

Thus, this joint conception of a short circuited antenna and a resonating filtering device shrewdly enables the filtering device to widen the bandwidth of the antenna, and for the antenna to improve the out of band rejection properties of the filtering device.

In an optional manner, the additional conducting strip is rectilinear and arranged in a direction orthogonal to the main direction of the supply line.

Also in an optional manner, the additional conducting strip is arranged at a predetermined distance from a supply point of the two halves of the radiating dipole by the bi-strip supply line, this distance being chosen sufficiently small to shift towards low frequencies a resonance generated by the short circuit on the radiating dipole.

Also in an optional manner, the first and second halves of the thick radiating dipole are of semi elliptic, elliptic or triangular shape.

Also in an optional manner, the resonating filtering device comprises a pair of coupled resonators arranged on said same surface, each resonator comprising two conducting strips positioned in a symmetrical manner in relation to an axis of said same surface, said two conducting strips being connected respectively to two conductors of a bi-strip port for connection to a bi-strip line for transmission of a differential signal.

Also in an optional manner, each conducting strip of each resonator is folded over itself so as to form a capacitive coupling between its two ends.

Thus, the folding of each conducting strip over itself makes it possible to envisage a smaller size of filter, particularly a length of filter less than the apparent half wavelength, for geometric reasons. Moreover, the fact that this folding is conceived so as to form a capacitive coupling between the two ends of each conducting strip creates at least one additional frequency transmission zero ensuring high performance in width of bandwidth and in out of band rejection of the filtering device. Finally, since the capacitive coupling by folding also generates a magnetic coupling, the size of each conducting strip can further be reduced while ensuring a same filtering function of the whole.

Finally, also in an optional manner, a differential dipole antenna system according to the invention may moreover comprise a quarter wavelength line with two coplanar conducting strips arranged so as to connect, in impedance matching, the bi-strip line supplying the antenna to the filtering device, this quarter wavelength line being adapted in the form of a printed circuit to exhibit discontinuities of structure generating at least one impedance jump and at least one capacitive coupling between its two conducting strips so as to reproduce a quarter wave phase difference.

Another object of the invention is a device for transmitting and/or receiving a wide bandwidth signal, comprising an antenna system as defined previously.

Wide bandwidth signal is taken to mean a signal transmitted or received for a high speed communication, complying with one of the different UWB communication standards aimed at wide bandwidth communications.

Finally, another object of the invention is a differential dipole antenna that comprises, on a same surface of a dielectric substrate, a first half of a thick radiating dipole, a first conducting strip of a bi-strip line for supplying a differential signal, said first conducting strip being connected to the first half of the thick radiating dipole, a second half of a thick radiating dipole and a second conducting strip of the bi-strip supply line, said second conducting strip being connected to the second half of the thick radiating dipole, the antenna moreover comprising on said same surface an additional conducting strip defining a short circuit connecting the first half and the second half of the thick dipole, and being able to be connected to a differential resonating filtering device to form an antenna system as defined previously.

BRIEF DESCRIPTION OF THE DRAWINGS

The invention will be better understood by means of the following description, given uniquely by way of example and by referring to the appended drawings, in which.

DETAILED DESCRIPTION OF THE PREFERRED EMBODIMENTS

Figure 1:
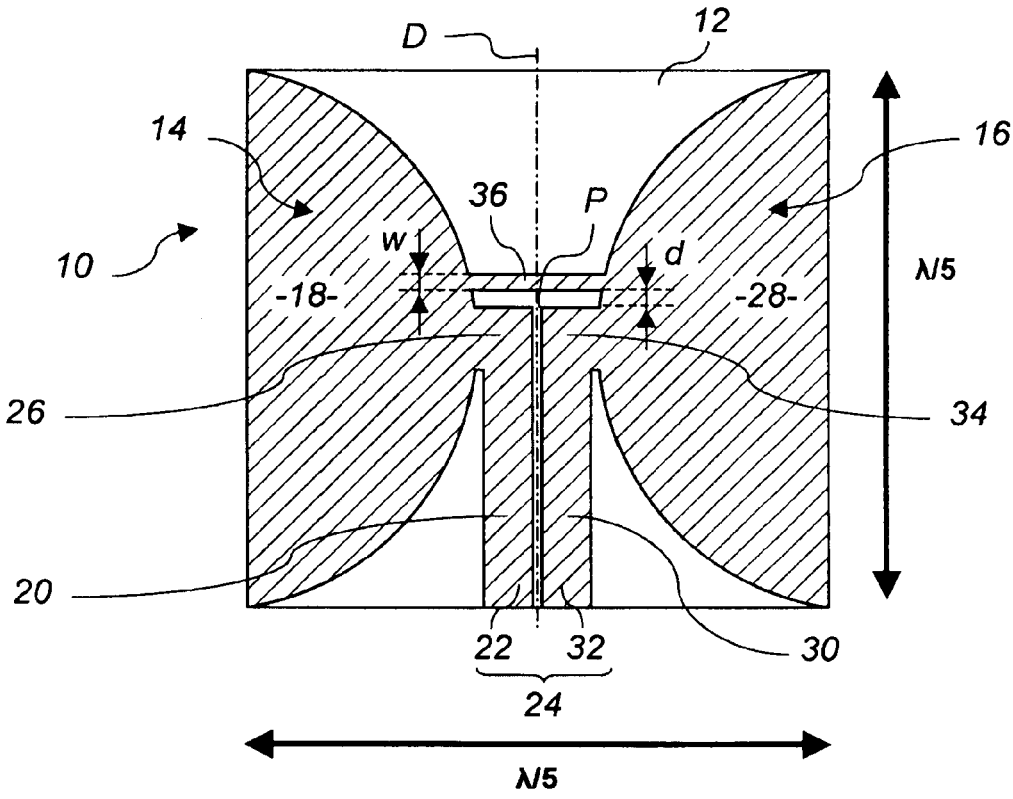
FIG. 1 schematically represents the general structure of a differential dipole antenna according to an embodiment of the invention.

The differential dipole antenna 10 illustrated in FIG. 1 comprises, on a same surface 12 of a dielectric substrate, a first antenna arm 14 and a second antenna arm 16, arranged in a symmetrical manner in relation to an axis D.

The first antenna arm 14 comprises a first half 18 of a thick radiating dipole and a first conducting strip 20 of a bi-strip line supplying a differential signal.

The first half 18 of the thick radiating dipole is more precisely, in the example illustrated in this figure, a half ellipse, the large axis of which is parallel to the axis D and constituting one of the lateral edges of the surface 12 of the dielectric substrate on which is printed the antenna 10: in the referential of FIG. 1, it is more precisely the left lateral edge.

The first conducting strip 20 is of rectilinear shape and extends parallel to and close to the axis D, on the side of the first half 18 of the thick radiating dipole. One 22 of its ends forms a first conductor of a bi-strip port 24 for connection to an external differential device (not represented). The other 26 of its ends comprises a bend towards the left to connect the first conducting strip 20 to the convex part of the first half 18 of the thick radiating dipole, at the level of the small axis of the half ellipse.

In a symmetrical manner, the second antenna arm 16 comprises a second half 28 of the thick radiating dipole and a second conducting strip 30 of the bi-strip line supplying a differential signal.

The second half 28 of the thick radiating dipole is more precisely, in the example illustrated in this figure, a half ellipse, the large axis of which is parallel to the axis D and constituting the right lateral edge of the surface 12 of the dielectric substrate on which is printed the antenna 10.

The second conducting strip 30 is of rectilinear shape and extends parallel to and close to the axis D, on the side of the second half 28 of the thick radiating dipole. One 32 of its ends forms the second conductor of the bi-strip port 24 for connection to an external differential device. The other 34 of its ends comprises a bend to the right to connect the second conducting strip 30 to the convex part of the second half 28 of the thick radiating dipole, at the level of the small axis of the half ellipse.

A point P of supplying the differential dipole antenna 10 is defined as being the intersection between the axis D and the axis of the upper edges of the two bends 26 and 34, the direction of which is orthogonal to the axis D.

The differential dipole antenna 10 is of generally square shape. If it was simply constituted of the two arms described previously, each side of this square shape would be of the order of an apparent half wavelength.

But in fact, according to a first aspect of the invention, the dipole antenna 10 moreover comprises, on the same surface 12 of the dielectric substrate, an additional conducting strip 36 connecting the first half 18 and the second half 28 of the thick dipole. In this way, the additional conducting strip 36 forms a short circuit between the first 18 and second 28 halves of the thick dipole. It is of thickness w of rectilinear shape and of main direction orthogonal to the axis D, in other words orthogonal to the main direction of the two conducting strips of the differential bi-strip supply line, or parallel to the direction of the upper edges of the two bends 26 and 34. It is situated at a distance d from the supply point P.

This short circuit makes it possible to obtain a significant reduction in the total surface area of the antenna. Indeed, it behaves like an impedance matching network and ensures a resonance at a lower frequency than the natural resonance frequency of the antenna 10 if it were simply constituted of two antenna arms 14 and 16. Thus, at constant size of antenna, the operating wavelengths increase. In other words, for a given upper operating wavelength, the size of the antenna is significantly reduced. In a more precise manner, it is thus possible to gain 60% in each dimension, in other words to conceive an antenna of general square shape, each side of which is of the order of a fifth of apparent wavelength.

Figure 2:
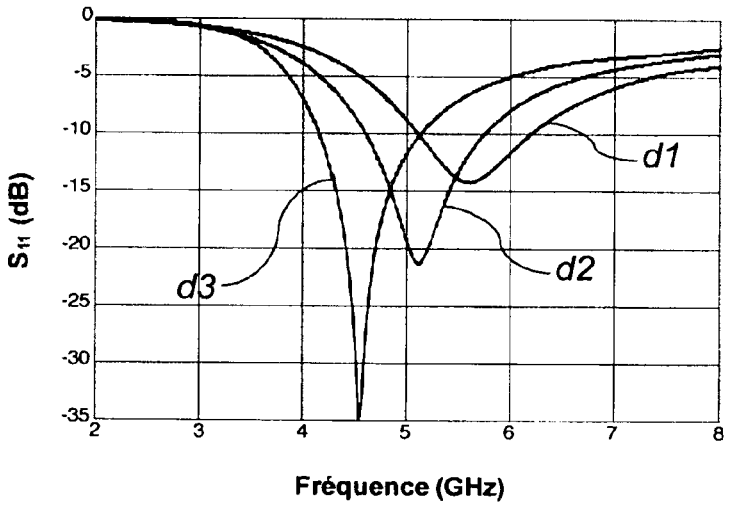
FIG. 2 illustrates the characteristic of a reflection frequency response of the differential dipole antenna of FIG. 1.

The graph illustrated in FIG. 2 represents the characteristic of a reflection frequency response of the differential dipole antenna 10 described previously for operating frequencies close to 5 GHz.

It may be noted in this graph that the presence of the short circuit generates a resonance. This resonance varies as a function of the distance d between the short circuit 36 and the supply point P. For a first distance d=d1, for example 5 mm, the reflection coefficient $S_{11}$ of the frequency response has a resonance at 5.6 GHz. For a second distance d=d2 less than d1, for example 2 mm, the reflection coefficient $S_{11}$ of the frequency response has a more accentuated resonance at 5.2 GHz. For a third distance d=d3 less than d2, for example 0.5 mm, the reflection coefficient $S_{11}$ of the frequency response has an even more accentuated resonance at 4.6 GHz. It may be concluded from these observations that the shorter the distance d between the short circuit 36 and the supply point P, the more the antenna 10 may be miniaturised by a phenomenon of reduction of its resonance frequency. On the other hand, it is also observed that the shorter the distance d, the more the bandwidth of the antenna 10 is reduced by accentuation of this resonance.

Consequently, the distance d between the additional conducting strip forming the short circuit 36 and the supply point P must be chosen sufficiently small to shift towards low frequencies the resonance generated by the short circuit on the radiating dipole and to attain a desired miniaturisation, but sufficiently large to conserve an acceptable bandwidth as a function of the desired use of the antenna 10.

In a purely illustrative manner, the dipole antenna is for example supplied by a bi-strip line of 100Ω (optimised to have an input impedance of 100Ω) and formed on a substrate with the following characteristics: $\in_r$=3.38, tg(δ)=0.003 and thickness=0.5 mm. The conducting strips of the supply line are chosen of width 1.5 mm and spaced apart by 0.25 mm. The half ellipses of the two halves of dipole have a large axis of 8.5 mm and a small axis of 7 mm. The width w of the short circuit 36 is chosen at 0.5 mm and the distance d is adjustable to vary the resonance generated by the short circuit according to the desired application or reduction. For a distance d equal to 0.5 mm, a differential dipole antenna having a surface of 17×17.85 mm is thus obtained. This size makes it possible to envisage integrating the antenna in communicating devices that are themselves also small. At these dimensions, it will be noted also that the antenna has an impedance matching at $|S_{11}| \leq -10$ dB (bandwidth generally accepted for antennas) between 4 and 5 GHz.

Figure 3:
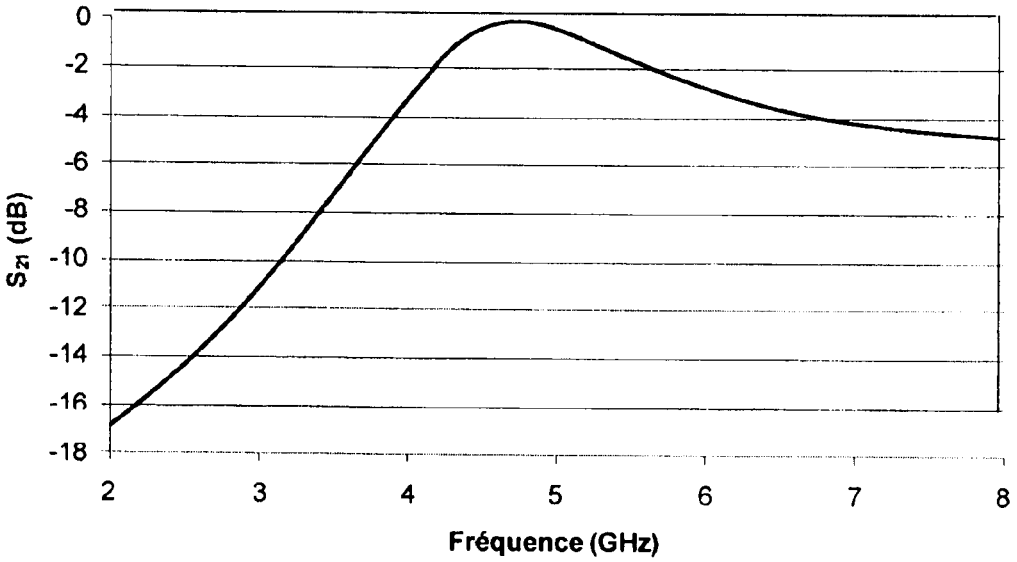
FIG. 3 illustrates the characteristic of a transmission frequency response of the differential dipole antenna of FIG. 1.

The graph illustrated in FIG. 3 represents the characteristic of a transmission frequency response of the differential dipole antenna 10 described previously for operating frequencies close to 5 GHz.

The transmission coefficient $S_{21}$ of this frequency response has an important rejection slope in low band, much more important particularly than in high band. The differential dipole antenna 10 may then be compared to a first order high pass filter. Therefore, this frequency response filtering antenna is just right to be integrated with a band pass filter, since the frequency response of the antenna can contribute to improving the low band rejection of such a filter. But this filter must also be chosen so as to be able to adapt the impedance of the antenna that is reduced by the addition of the highly resonating short circuit.

Figure 4:
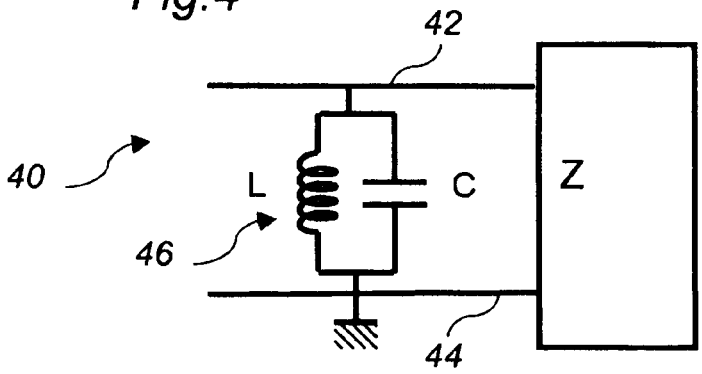
FIG. 4 represents an equivalent electrical diagram of the differential dipole antenna of FIG. 1, FIG. 5 schematically represents the general structure of an example of filtering device for the formation of a differential dipole antenna system according to the invention.

The short circuited antenna may be modelled by an equivalent electrical circuit 40 illustrated in FIG. 4. The addition of the short circuit 36 to the antenna initially not short circuited in fact creates an L, C type resonator added in parallel to the input impedance Z of the antenna initially not short circuited.

This electrical circuit 40 modelling the short circuited antenna thus comprises two conductor wires 42 and 44 between which is arranged a parallel LC circuit 46 modelling the L, C type resonator. These two conductor wires are connected to one of their ends at the impedance charge Z of the antenna 10 considered without its short circuit. The other two free ends are intended to be connected to an external dipole, not represented. The conductor wire 44 is, by convention, represented as being moreover connected to ground.

As has been indicated previously, in view of the prior art cited and in view of FIG. 3, there exists a need for integration of band pass filters with miniature antennas, such as that described previously, to reduce the dimensions of an assembly forming a filtering antenna. As has also been indicated, this strategy aiming to concentrate within a same component several functionalities, as it happens radiation and filtering, poses several difficulties, especially for new applications requiring structures with very wide band differential signals. Thus, according to this strategy, each constituent of the same component must be designed to ensure the optimal operation of the other constituents of the component while limiting the interconnections which reduce its overall performance by adding additional losses. It is also advisable to seek to eliminate in this type of component certain bulky constituents such as baluns. This may be achieved by the choice of a differential architecture, furthermore well adapted to the architectures of active integrated circuits.

According to a second aspect of the invention, a differential dipole antenna such as that which has been described previously thus advantageously comprises a differential resonating filtering device, the bandwidth of which is designed to combine with the resonance generated by the short circuit so as to produce an impedance matching of the antenna.

Thus, a differential dipole filtering antenna system according to the second aspect of the invention benefits, on the one hand, from the strong resonance introduced by the short circuit of the antenna to reinforce the low band filtering of the differential band pass filtering device directly connected to the antenna and, on the other hand, the bandwidth of the filtering device to better adapt the antenna and widen its bandwidth.

Moreover, by bringing closer the short circuit to the supply point of the filtering antenna, the filtering achieved is improved, as is the impedance matching.

For a better integration of the filtering device in the differential dipole antenna described previously, it is advantageously designed using coplanar technology. Thus, it may comprise a pair of coupled resonators arranged on the same surface of a dielectric substrate, each resonator comprising two conducting strips positioned in a symmetrical manner in relation to a plane perpendicular to said same surface, said two conducting strips being connected respectively to two conductors of a bi-strip port for connection to a bi-strip line for transmission of a differential signal.

This filtering device may for example be designed according to the example illustrated by FIG. 12 of the document "Broadband and compact coupled coplanar stripline filters with impedance steps", of Ning Yang et al., IEEE Transactions on Microwave Theory and Techniques, vol. 55, no 12, December 2007.

However, the compactness of this filtering device could also be advantageously improved. Combined with the improved compactness of the short circuited antenna described previously, it would then make it possible to envisage an even more compact differential dipole filtering antenna.

In a preferred embodiment, the filtering device is thus improved in compactness by folding each conducting strip of each resonator of the filtering device over itself so as to form a capacitive coupling between its two ends. This makes it possible to obtain in the end an ultra miniature filtering antenna that can be supplied with wide band differential signals.

Such a filtering device with improved compactness will now be detailed with reference to FIG. 5.

Figure 5:
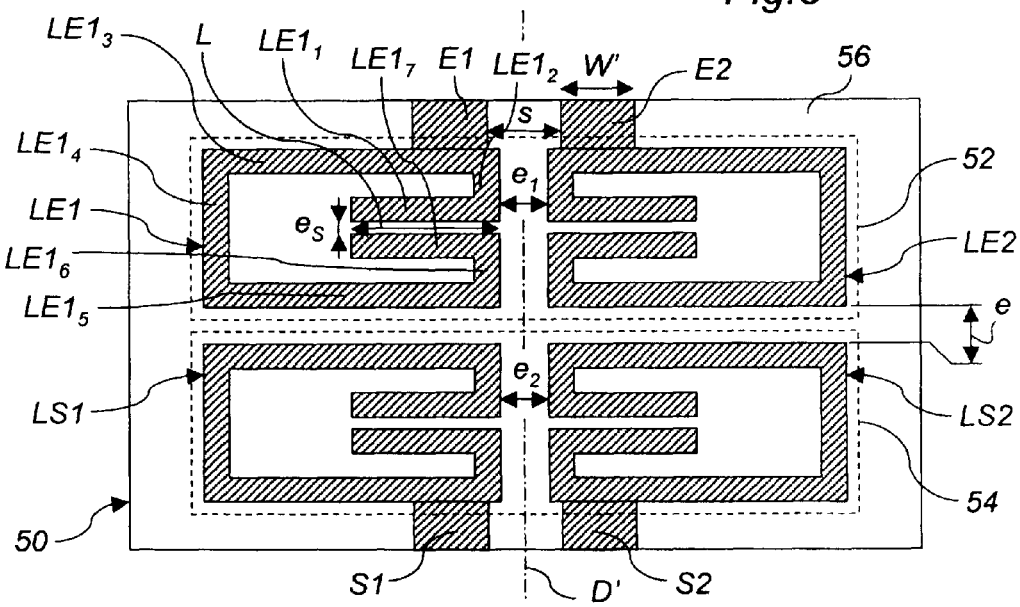

The differential filtering device 50 with coupled resonators represented in FIG. 5 comprises at least one pair of resonators 52 and 54, coupled together by capacitive coupling and arranged on the same flat surface 56 of a dielectric substrate.

The first resonator 52, constituted of a portion of bi-strip line, is connected to two conductors E1 and E2 of a bi-strip port for connection to a line for transmission of a differential signal. These two conductors E1 and E2 of the bi-strip port are symmetrical in relation to an axis D' through which passes a plane perpendicular to the flat surface 56 and forming a virtual electrical ground plane. They are of a width w' and spaced apart by a distance s, these two parameters s and w' defining the impedance of the bi-strip port.

Similarly, the second resonator 54, itself also constituted of a portion of bi-strip line, is connected to two conductors S1 and S2 of a bi-strip port for connection to a line for transmission of a differential signal. These two conductors S1 and S2 of the bi-strip port are also symmetrical in relation to the axis D'.

The two resonators 52 and 54 are themselves symmetrical in relation to an axis perpendicular to the axis D'. Consequently, the filtering device 50 is symmetrical between its differential input and output such that they can be entirely reversed. Thus, in the remainder of the description of the embodiment represented in FIG. 5, the two conductors E1 and E2 will be chosen by convention as being the bi-strip input port of the filtering device 50, for the reception of an unfiltered differential signal. The two conductors S1 and S2 will be chosen by convention as being the bi-strip output port of the filtering device 50, for the supply of the filtered differential signal.

More specifically, the first resonator 52 comprises two conducting strips identified by their references LE1 and LE2. These two conducting strips LE1 and LE2 are positioned in a symmetrical manner in relation to the axis D'. They are respectively connected to the two conductors E1 and E2 of the input port. The second resonator 54 comprises two conducting strips identified by their references LS1 and LS2. These two conducting strips LS1 and LS2 are also positioned in a symmetrical manner in relation to the axis D'. They are respectively connected to the two conductors S1 and S2 of the output port.

The capacitive coupling of the two resonators 52 and 54 is ensured by the arrangement facing each other but without contact of their respective pairs of conducting strips. Thus, the conducting strips LE1 and LS1, situated on a same side in relation to the axis D', are arranged facing each other at a distance e from each other. Similarly, the conducting strips LE2 and LS2, situated on the other side in relation to the axis D', are arranged facing each other at the same distance e from each other.

This distance e between the two resonators 52 and 54 mainly influences the bandwidth of the filtering device 50 and has a secondary effect on its impedance characteristic. The more e is reduced, in other words the more the capacitive coupling is high between the two resonators, the wider the bandwidth. This also has the effect of increasing the impedance. More specifically, the bandwidth is widened by the appearance of two different reflection zeros within this bandwidth, corresponding to two different resonance frequencies, when e is sufficiently small to form the capacitive coupling between the two resonators. The shorter the distance e, the more the two reflection zeros created move apart from each other, thus widening the bandwidth. However, if they are too far apart, they can bring about the separation of the widened bandwidth into two different bandwidths through reappearance of an important reflection between the two zeros, which goes against the desired effect. Consequently, the distance e must be sufficiently small to increase the bandwidth but also sufficiently large so as not to generate undesirable reflection within the bandwidth.

In a conventional manner, for a correct operation of the resonators of a filtering device with coupled resonators, each conducting strip must be of length $\lambda/4$, where $\lambda$ is the apparent wavelength, for a substrate considered, corresponding to the upper operating frequency of the filtering device. Thus, if the conducting strips were arranged linearly in the continuation of the input and output ports of the filtering device 50, the assembly would reach a length close to $\lambda/2$: in practice, for a frequency of 3 GHz, a length close to 3 cm would for example be obtained.

But in fact, the conducting strips LE1, LE2, LS1 and LS2 are advantageously folded over themselves so as to form locally additional capacitive and magnetic couplings between their two ends. The size of the filtering device 50 is thus reduced for at least two reasons: the foldings geometrically bring about a reduction in size of the assembly, but moreover, thanks to the capacitive and magnetic couplings, the size of each conducting strip may be further reduced while ensuring good operation of the resonators. This capacitive and magnetic coupling moreover generates feedback between the input and the output of each conducting strip, so as to create one or more additional transmission zeros at frequencies higher than the upper limit of the bandwidth of the filtering device 50. The high band rejection is thus improved.

In the embodiment illustrated in FIG. 5, the four conducting strips are of general annular shape, the ends being folded inside this general annular shape on a predetermined portion of their length.

For a correct operation of the filtering device 50, the folding of the ends of each conducting strip is situated on a portion of this conducting strip arranged facing the other conducting strip of the same resonator. Thus, the foldings of the ends of the conducting strips LE1 and LE2 are arranged facing each other on either side of the axis D' and close to it.

More precisely, the conducting strip LE1 is of general rectangular shape and constituted of rectilinear conductor segments. A first segment $LE1_1$ comprising a first free end of the conducting strip LE1 extends towards the inside of the rectangle formed by the conducting strip over a length L in a direction orthogonal to the axis D'. A second segment $LE1_2$, connected to this first segment at right angle, constitutes a portion of the side of the rectangle parallel to the axis D' and close to it. A third segment $LE1_3$, connected to this second segment at right angle, constitutes the side of the rectangle orthogonal to the axis D' and connected to the conductor E1 of the input port. A fourth segment $LE1_4$, connected to this third segment at right angle, constitutes the side of the rectangle parallel to the axis D' and close to an exterior edge of the substrate. A fifth segment $LE1_5$, connected to this fourth segment at right angle, constitutes the side of the rectangle orthogonal to the axis D' and opposite the side $LE1_3$. A sixth segment $LE1_6$, connected to this fifth segment at right angle, constitutes like the second segment $LE1_2$ a portion of the side of the rectangle parallel to the axis D' and close to it. Finally, a seventh segment $LE1_7$ comprising the second free end of the conducting strip LE1, connected to the sixth segment at right angle, extends towards the inside of the rectangle over the length L in a direction orthogonal to the axis D', in other words parallel to the segment $LE1_1$ and facing it over the whole folding length L.

The segments $LE1_1$ and $LE1_7$ are separated by a constant distance $e_S$ over their whole length, which ensures their capacitive coupling.

The conducting strip LE1 may also be seen as constituted of a main folded conducting strip connected at one of its ends to the conductor E1, said main conducting strip comprising the segments $LE1_1$, $LE1_2$ and the portion of the segment $LE1_3$ situated between the segment $LE1_2$ and the conductor E1, and of a "stub" type by-pass folded over the main conducting strip, said "stub" type by-pass comprising the other portion of the segment $LE1_3$, and the segments $LE1_4$ to $LE1_7$. The "stub" type by-pass is then considered as laid at the junction between the main conducting strip and the conductor E1. It should theoretically have a total length of $\lambda/4$, but the capacitive and magnetic couplings generated by the folding of the conducting strip LE1 over itself make it possible to reduce this length, particularly from 10 to 20% on the "stub" by-pass.

It is moreover interesting to note that a sufficiently reduced size of the segment $LE1_4$ makes it possible to bring together the segments $LE1_3$ and $LE1_5$, but also the segments $LE1_3$ and $LE1_1$, or the segments $LE1_5$ and $LE1_7$, so as to multiply the number of capacitive and magnetic couplings generated by the folding of the conducting strip LE1 over itself. These multiple couplings improve the operation of the filtering device 50.

The coupling length L between the two folded ends, i.e. the two segments $LE1_1$, and $LE1_7$, mainly influences the bandwidth of the filtering device 50, but also has a secondary effect on the high band rejection. The more it increases, the more the bandwidth is reduced but the more the high band rejection is improved.

The distance $e_S$ between the two folded ends mainly influences the high band rejection of the filtering device 50: the more it is reduced, the more the high band rejection is improved. It will be noted however that this distance cannot be less than a limit imposed by the precision of the etching of the conducting strip LE1 on the substrate.

The conducting strip LE2 is constituted, like the conducting strip LE1, of seven conductor segments $LE2_1$ to $LE2_7$ arranged on the flat surface 56 of the substrate in a manner symmetrical to the seven segments $LE1_1$ to $LE1_7$ in relation to the axis D'. The two conducting strips LE1 and LE2 are separated by a constant distance $e_1$, corresponding to the distance that separates the segments $LE1_2$ and $LE1_6$, on the one hand, and the segments $LE2_2$ and $LE2_6$, on the other hand.

This distance $e_1$ mainly influences the impedance of the first resonator 52, in other words the input impedance of the filtering device 50, but also has a secondary effect on the bandwidth of the filtering device 50. The greater it is, the more the impedance increases and, in a less obvious manner, the more the bandwidth is reduced.

Since the two resonators 52 and 54 are symmetrical in relation to an axis perpendicular to the axis D', the conducting strips LS1 and LS2 are each constituted, like the conducting strips LE1 and LE2, of seven conductor segments $LS1_1$ to $LS1_7$ and $LS2_1$ to $LS2_7$ respectively, printed on the flat surface 56 of the substrate in a manner symmetrical to the segments of conducting strips LE1 and LE2 in relation to this axis. By symmetry also, the two conducting strips LS1 and LS2 are separated by a constant distance $e_2$ equal to $e_1$, corresponding to the distance that separates the segments $LS1_2$ and $LS1_6$, on the one hand, and the segments $LS2_2$ and $LS2_6$, on the other hand.

This distance $e_2$ also mainly influences the impedance of the second resonator 54, in other words the output impedance of the filtering device 50, but also has a secondary effect on the bandwidth of the filtering device 50. The greater it is, the more the impedance increases and, in a less obvious manner, the more the bandwidth is reduced.

The distance e separating the two resonators 52 and 54 corresponds to the distance that separates the segments $LE1_5$ and $LE2_5$, on the one hand, and the segments $LS1_5$ and $LS2_5$, on the other hand. The capacitive coupling between the two resonators 52 and 54 is thus established over the whole length of the segments $LE1_5$ and $LE2_5$, on the one hand, and the segments $LS1_5$ and $LS2_5$, on the other hand.

In a topology such as that illustrated in FIG. 5, where the length of the rectangle formed by any of the conducting strips is around twice its width and where the folding of length L is done over half of the length of the rectangle inside it, dimensions of the rectangle formed by each conducting strip close to $\lambda/30$ by $\lambda/60$ are obtained, i.e. dimensions of the filtering device 50 close to $\lambda/15$ by $\lambda/30$. These dimensions make it possible to attain a markedly better compactness than that of existing filtering devices.

Figure 6:
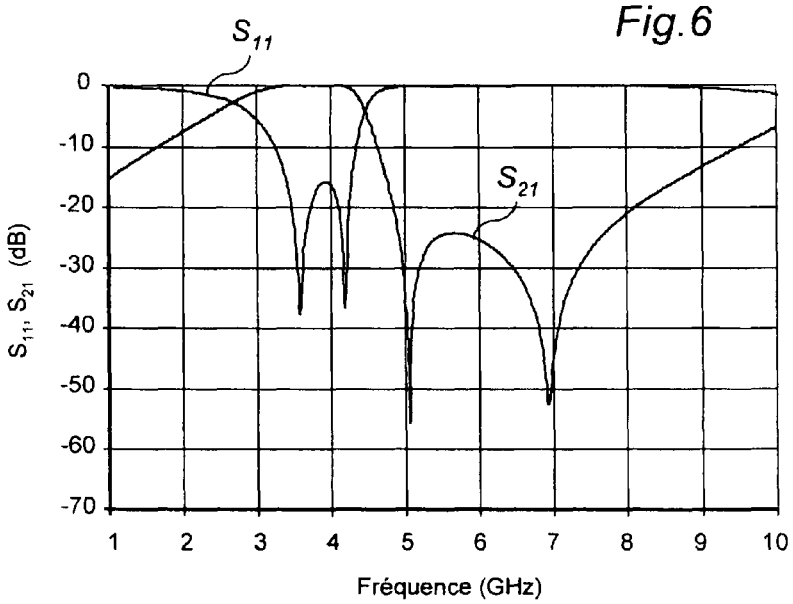
FIG. 6 illustrates the characteristic of a transmission and reflection frequency response of the filtering device of FIG. 5.

The graph illustrated in FIG. 6 represents the characteristic of a transmission and reflection frequency response of the filtering device described previously.

The reflection coefficient $S_{11}$ of this frequency response shows a bandwidth at −10 dB (generally accepted definition of the reflection bandwidth) between around 3.2 and 4.4 GHz. As indicated previously, the bandwidth is widened by the presence of two different reflection zeros within this bandwidth, said two zeros being due to the presence of the two coupled resonators distant by e in the filtering device 50. However, it may be seen in FIG. 6 that if they are too far apart, the portion of curve $S_{11}$ situated between these two reflection zeros can rise above −10 dB, which generates a separation of the widened bandwidth into two separate bandwidths. Consequently, the distance e must not be too small so as not to cause reflection greater than −10 dB in the widened bandwidth.

The transmission coefficient $S_{21}$ of the frequency response shows a bandwidth at −3 dB (generally accepted definition of the transmission bandwidth), between around 2.7 and 4.5 GHz, as well as two transmission zeros at around 5.1 and 6.9 GHz.

One of these two out of band transmission zeros is due to coupling between the two resonators of the filtering device 50 over the whole length of their portions $LE1_5$, $LE2_5$ on the one hand and $LS1_5$, $LS2_5$ on the other hand. The other of these two transmission zeros is due to the additional intra-resonator couplings created by the folding of the conducting strips over themselves. These two transmission zeros lead to a high rejection of the filter in high band and an asymmetry of the frequency response due to the average rejection in low band. But this asymmetry proves to be advantageous for a direct integration application of the filtering device 50 in the differential dipole antenna 10 described previously to supply a differential dipole filtering antenna, according to the second aspect of the invention. Indeed, the frequency response of this antenna has strong resonances at low frequency and is consequently equivalent to a high pass filter, which compensates the asymmetry of the filtering device 50 by improving its low band rejection.

Figure 7:
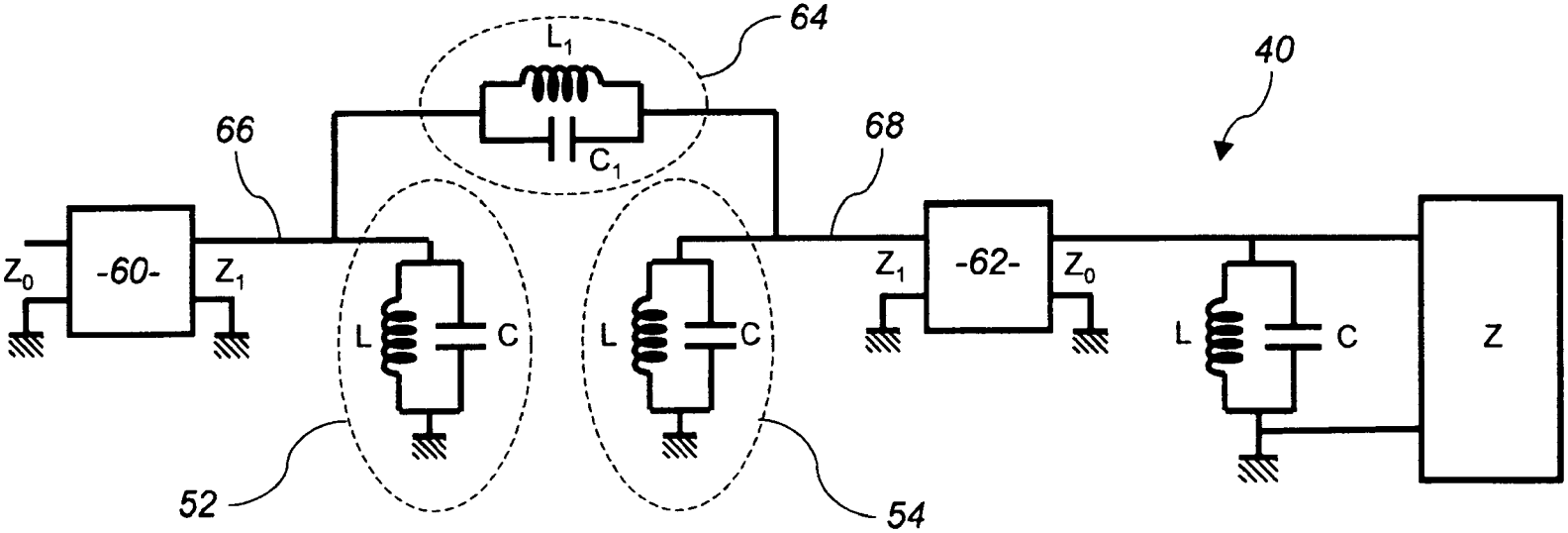
FIG. 7 represents an equivalent electrical diagram of a differential dipole antenna system according to the invention, FIG. 8 schematically represents the general structure of an example of quarter wave differential bi-strip line for the formation of a differential dipole antenna system according to the invention, FIG. 9 schematically represents the general structure of a differential dipole antenna system according to a first embodiment of the invention.

FIG. 7 schematically presents an equivalent electrical circuit of a differential dipole filtering antenna according to the second aspect of the invention.

In this circuit, a first inverter 60 represents an impedance jump, from $Z_0$ to $Z_1$, at the input of the filtering device 50. The impedance $Z_0$ is determined by the parameters s and w' of the conductors E1 and E2 of the input port of the filtering device 50, whereas the impedance $Z_1$ is particularly determined by the distance $e_1$ between the conducting strips LE1 and LE2.

A second inverter 62 represents the corresponding impedance jump, from $Z_1$ to $Z_0$, at the output of the filtering device 50.

The first and second coupled resonators 52 and 54 are each represented by a LC circuit with capacitance C and inductance L in parallel. These two circuits LC are connected, on the one hand, respectively to the first and second inverters 60 and 62 and, on the other hand, to ground.

Finally, the folding of the conducting strips LE1, LE2, LS1 and LS2 creates additional couplings, inside each resonator but also between the resonators, which can be represented by a LC feedback circuit 64, with capacitance C1 and inductance L1 in parallel, connected, on the one hand, to the junction 66 between the first resonator 52 and the first inverter 60 and, on the other hand, to the junction 68 between the second resonator 54 and the second inverter 62. This LC feedback circuit 64 improves the high band rejection of the filtering device 50 by the addition of one or more transmission zeros in high frequencies.

The junction of the radiating antenna 10 and the filtering device 50 is modelled in this circuit by the connection of the inverter 62 to the free ends of the two conductor wires 42 and 44 of the electrical circuit 40, via the ground as regards the conductor wire 44

The addition of the short circuit into the structure of the antenna creates a resonator resonating at low frequency: the parallel LC circuit 46. The addition of this resonator to the filtering device 50 increases its order and thus improves its performance. Indeed, it creates within the bandwidth of the filtering device an additional zero reflection that contributes to the widening of the bandwidth of the assembly and to an improvement of the impedance matching in the bandwidth. In addition, since the resonance of the short circuit takes place at low frequency, it contributes to improving the rejection of the filtering device, which has a moderate rejection in its lower band.

According to the second aspect of the invention, in an optional manner, a differential dipole filtering antenna with improved compactness may moreover comprise a quarter wavelength line intended to improve the impedance matching between the filtering device and the radiating part of the antenna. Advantageously, this quarter wavelength line itself has improved compactness. It is arranged between the filtering device and the radiating part of the antenna so as to connect, in impedance matching, the bi-strip supply line of the antenna to one of the bi-strip ports of the filtering device.

Such a quarter wavelength line with improved compactness and able to transmit a differential signal is represented in FIG. 8. It is adapted in printed circuit to have discontinuities of structure generating at least one impedance jump and at least one capacitive coupling between its two conducting strips, thus fulfilling the same functions as a conventional quarter wavelength line.

In this figure, a quarter wave bi-strip line 70 comprises two conducting strips 72 and 74 arranged on the same flat surface 76 of a dielectric substrate.

The conducting strip 72 comprises a first end E1 and a second end S'1. Similarly, the second conducting strip 74 comprises a first end E'2 and a second end S'2.

The two first ends E'1 and E'2 of the two conducting strips 72 and 74 form respectively two conductors of a first bi-strip port 78 for connection to a first external differential device (not represented in this figure) and the two second ends S'1 and S'2 of the two conducting strips form respectively two conductors of a second bi-strip port 80 for connection to a second external differential device (not represented in this figure). The ends E'1 and E'2, on the one hand, and S'1 and S'2, on the other hand, are symmetrical in relation to an axis D" of the flat surface 76.

The capacitive coupling and the impedance jumps of the bi-strip line 70, conferring on it a quarter wavelength line phase difference, are directly generated by the discontinuities of structure, themselves generating an inductance and a capacitance. More specifically, these discontinuities of structure comprise, on the one hand, linearity ruptures of the conducting strips 72 and 74 and, on the other hand, formations of additional conducting branches extending from the conducting strips 72 and 74.

The linearity ruptures make it possible to vary the distance between the two conducting strips for the realisation of at least one impedance jump.

Thus, the first conducting strip 72 has several linearity ruptures enabling a portion 72A of this conducting strip 72 to be further away from the axis D" than the portions E'1 and S'1 forming the ends of this conducting strip 72, while maintaining the portions E'1, S'1 and 72A parallel to the axis D". These linearity ruptures are formed by a portion 72B of the conducting strip 72, extending laterally and orthogonally to the axis D" from one end of the portion E'1 towards one end of the portion 72A, and by one portion 72C of the conducting strip 72, extending laterally and orthogonally to the axis D" from the other end of the portion 72A to one end of the portion S'1.

By symmetry, the second conducting strip 74 has several linearity ruptures enabling a portion 74A of this conducting strip 74 to be further away from the axis D" than the portions E'2 and S'2 forming the ends of said conducting strip 74, while maintaining the portions E'2, S'2 and 74A parallel to the axis D". These linearity ruptures are formed by a portion 74B of the conducting strip 74, extending laterally and orthogonally to the axis D" from one end of the portion E'2 to one end of the portion 74A, and by a portion 74C of the conducting strip 74, extending laterally and orthogonally to the axis D" from the other end of the portion 74A to one end of the portion S'2.

Consequently, the bi-strip line 70 has a first discontinuity of structure, increasing the distance between its two conducting strips 72 and 74, formed by the portions 72B and 74B, for the realisation of a first impedance jump by increase of said impedance. Indeed, the impedance increases with the distance between the two conducting strips.

It also has a second discontinuity of structure, reducing the distance between its two conducting strips 72 and 74, formed by the portions 72C and 74C, for the realisation of a second impedance jump by reduction of this impedance.

These two discontinuities of structure create a rectangular area, essentially defined by the portions 72B, 72A, 72C, 74C, 74A and 74B, in which the bi-strip line 70 has a spacing between its conducting strips 72 and 74 greater than the spacing between the two conductors E'1, E'2 and S'1, S'2 of each of its bi-strip connection ports 78 and 80.

The formations of additional conduction branches extending from the conducting strips 72 and 74 make it possible to create at least one interdigitated capacitance for the realisation of the capacitive coupling between the two conducting strips 72 and 74.

More specifically, in the example of FIG. 8, an interdigitated capacitance is formed by two conductor fingers 72D and 74D extending parallel to each other and orthogonally to the axis D", facing each other over at least one portion of their length. The conductor finger 72D is constituted of a portion of rectilinear conducting strip, one end of which is integral with the portion 72A of the first conducting strip 72 and the other end remains free, whereas the conductor finger 74D is constituted of a portion of rectilinear conducting strip, one end of which is integral with the portion 74A of the second conducting strip 74 and the other end remains free.

The pair of conductor fingers thus extends laterally towards the inside of the rectangular area defined previously from the portions 72A and 74A of the two conducting strips 72 and 74, which makes it possible to profit from the area of the substrate in which the bi-strip line 70 has a larger spacing between its conducting strips 72 and 74 to form the interdigitated capacitance.

In a variant, it is possible to create several parallel interdigitated capacitances in the rectangular area defined previously. This makes it possible to increase the capacitance of the printed circuit formed by the bi-strip line 70 without changing its inductance. In other words, it involves an additional parameter of adjustment of the impedance characteristic of the bi-strip line 70 at a given phase difference. It will be noted however that the addition of interdigitated capacitances increases the length and thus the size of the bi-strip line, which is not always desirable.

In a concrete manner, it is simple for those skilled in the art to adjust the dimensions of the aforementioned different constituents of the bi-strip line 70, so as to obtain a quarter wavelength line by adjustment, particularly, of its capacitive coupling and its impedance jumps.

The length l of the bi-strip line 70 thus formed is considerably less than the length of a bi-strip quarter wave line of the prior art, which would be constituted of two rectilinear and parallel conducting strips, thanks to the discontinuities of structure. It ensues that the bi-strip line 70 has better compactness while keeping the same characteristics as a bi-strip quarter wave line of the prior art.

A differential dipole filtering antenna 82 with improved compactness, resulting from the joint formation of the radiating antenna 10 represented in FIG. 1, the filtering device 50 represented in FIG. 5 and the quarter wavelength line 70 represented in FIG. 8, is represented in FIG. 9.

One of the two bi-strip ports of the filtering device 50 is connected to one of the two bi-strip ports of the quarter wavelength line 70 which fulfils a function of impedance inverter. The other of the two bi-strip ports of the quarter wavelength line 70 is for its part connected to the bi-strip port 24 of the dipole antenna 10.

The example shown in this figure is designed to operate in the band of frequencies 4.2-5 GHz allocated to high speed UWB communications in Europe. This antenna is particularly suitable for communications by means of USB type devices. It is etched on a substrate with high permittivity ($\in_r$=10) to further increase its miniaturisation.

The overall size of the square filtering antenna 82 thus formed is around one fifth of apparent wavelength for each side. It will be noted that these dimensions are practically those of the short circuited antenna alone illustrated in FIG. 1, the filtering device 50 contributing to the miniaturisation of the antenna while ensuring its impedance matching at low frequency.

Figure 10:
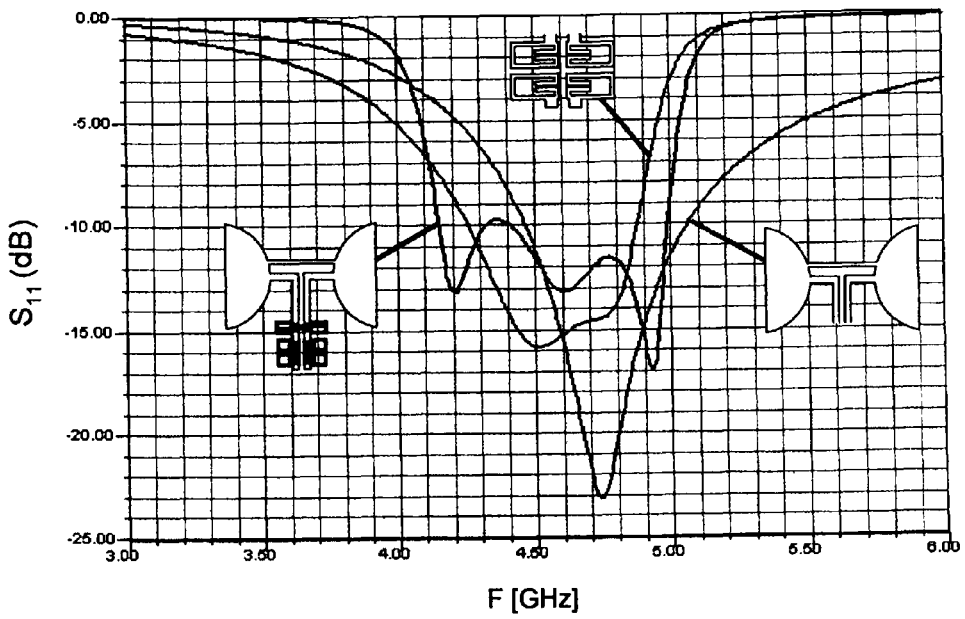
FIG. 10 illustrates the characteristic of a reflection frequency response of the differential dipole antenna system of FIG. 9.

The graph illustrated in FIG. 10 represents the comparative characteristics of a reflection frequency response of the radiating antenna 10, of the filtering device 50 and of the filtering antenna 82.

It can be seen therein that the reflection coefficient $S_{11}$ of the frequency response of the filtering antenna 82 has a bandwidth at −10 dB considerably wider than that of the filtering device 50 alone or of the radiating antenna 10 alone. The reflection coefficient $S_{11}$ of the frequency response of the radiating antenna 10 alone is not adapted to the desired UWB application, but to a narrower band between 4.45 and 5.05 GHz. The filtering device alone is for its part adapted between 4.25 and 4.9 GHz. On the other hand, the combination of the radiating antenna and the filtering device, by an effect of impedance matching of the radiating antenna, is adapted between 4.15 and 5 GHz, the desired range of frequencies.

Moreover, the low and high band rejections are also improved and rebalanced. Finally, the order of the filtering is increased.

Figure 11:
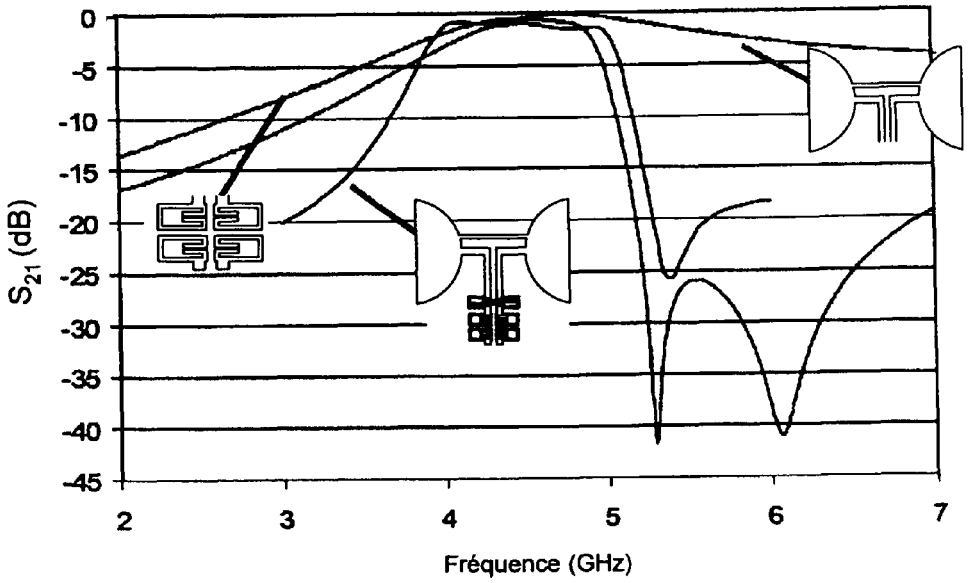
FIG. 11 illustrates the characteristic of a transmission frequency response of the differential dipole antenna system of FIG. 9, FIGS. 12 and 13 schematically represent the general structure of a differential dipole antenna system according to second and third embodiments of the invention.

The graph illustrated in FIG. 11 represents the comparative characteristics of a transmission frequency response of the radiating antenna 10, of the filtering device 50 and of the filtering antenna 82.

It may be seen therein that the transmission coefficient $S_{21}$ of the frequency response of the filtering antenna 82 has a bandwidth at −3 dB significantly more selective than that of the filtering device 50 alone. Moreover, the low and high band rejections are also improved and rebalanced by the combination of the high-pass filtering effect of the first order of the short circuited antenna and of the initial asymmetrical filtering of the filtering device 50.

It thus appears clearly that the short circuit has a first effect on the radiating antenna itself by enabling its miniaturisation, but also a second effect on the filtering antenna by acting on the bandwidth of the filtering to improve the low and high band rejections and to enable the transmission/reception of differential wide band signals.

The aforementioned double effect of the short circuit on the filtering antenna described previously is not limited to this shape of dipole antenna. Other shapes of thick radiating dipoles are also suitable, whether with narrow, medium or wide bandwidths.

Thus, FIG. 12 represents a differential dipole filtering antenna 82' resulting from a joint formation of a radiating short circuited antenna 10' of butterfly type, of the filtering device 50 represented in FIG. 5 and of the quarter wavelength line 70 represented in FIG. 8. Its two halves of dipole are of triangular shape and connected to the bi-strip supply line of the antenna by one of their summits, for a relatively narrow bandwidth.

FIG. 13 represents a differential dipole filtering antenna 82" resulting from a joint formation of a radiating short circuited antenna 10" of elliptic type, of the filtering device 50 represented in FIG. 5 and of the quarter wavelength line 70 represented in FIG. 8. Its two halves of dipole are of elliptic shape and connected to the bi-strip supply line of the antenna by one end of their small axis, for a high bandwidth.

The filtering device 50 described previously constitutes a good solution to be integrated in these different types of antennas, thanks to its asymmetrical frequency response particularly adapted for a conception with short circuited antennas, but also because it makes it possible to attain a wide range of relative bandwidths, ranging from 15% to 70%. That said, other filters having a similar asymmetrical frequency response are also suitable.

It clearly appears that a differential dipole antenna such as one of those described previously can attain a much better compactness and a much smaller size than known differential dipole antennas formed using CPS differential technology, while conserving the possibility of being able to transmit and receive differential signals with wide band, according to the requirements of UWB communication applications.

Its compactness and is high performance make it moreover advantageous for miniature communicating objects, particularly USB type wireless portable devices.

The coplanar structure of this differential dipole antenna moreover facilitates its formation using hybrid technology and its integration in monolithic technology with structures comprising discrete constituents assembled on the surface. In particular, it is simple to conceive in integration with a band pass filtering device formed using coplanar technology, as has been illustrated by several examples, by chemical or mechanical etching on substrates with low or high permittivity depending on the desired applications and performances.

This antenna could particularly be manufactured on a substrate at low cost, but in this case the losses generated could reduce its performance. However, this solution may remain valid for certain applications intended for the general public.

This antenna can also find applications in the millimetric band of frequencies where its small size and its high performance enable it to be integrated at low cost in monolithic technology with transmission or reception circuits.

It also appears clearly that when it integrates a band pass filtering device, its short circuit has the effect of being able to improve the rejection of the filter in low band and to widen its bandwidth.

The filtering antenna thus formed then has optimal characteristics in terms of size, bandwidth, radiation, consumption and rejection of noises and interfering signals.

The invention claimed is:

1. A differential dipole antenna system that comprises, on a same surface of a dielectric substrate, a first half of a thick radiating dipole, a first conducting strip of a bi-strip line for supplying a differential signal, said first conducting strip being connected to the first half of the thick radiating dipole, a second half of a thick radiating dipole and a second conducting strip of the bi-strip supply line, said second conducting strip being connected to the second half of the thick radiating dipole, wherein said differential dipole antenna system further comprises:

on said same surface an additional conducting strip defining a short circuit connecting the first half and the second half of the thick dipole, and a differential resonating filtering device having a bandwidth adapted so as to be combined with the resonance generated by the short circuit so as to generate an antenna impedance matching.

2. The differential dipole antenna system according to claim 1, wherein the additional conducting strip is rectilinear and arranged in a direction orthogonal to the main direction of the supply line.

3. The differential dipole antenna system according to claim 1 or 2, wherein the additional conducting strip is arranged at a predetermined distance from a supply point of the two halves of the radiating dipole by the bi-strip supply line, said distance being chosen sufficiently small to shift towards low frequencies a resonance generated by the short circuit on the radiating dipole.

4. The differential dipole antenna system according to claim 1, wherein the first and second halves of the thick radiating dipole are of elliptic or semi elliptic shape.

5. The differential dipole antenna system according to claim 1, wherein the first and second halves of the thick radiating dipole are of triangular shape.

6. The differential dipole antenna system according to claim 1, wherein the differential resonating filtering device comprises a pair of coupled resonators arranged on said same surface, each resonator comprising two conducting strips positioned in a symmetrical manner in relation to an axis of said same surface, said two conducting strips being connected respectively to two conductors of a bi-strip port for connection to a bi-strip line for transmission of a differential signal.

7. The differential dipole antenna system according to claim 6, wherein each conducting strip of each resonator is folded over itself so as to form capacitive coupling between its two ends.

8. The differential dipole antenna system according to claim 1, comprising a quarter wavelength line with two coplanar conducting strips arranged so as to connect, in impedance matching, the bi-strip line for supplying the antenna to the filtering device, said quarter wavelength line being adapted in the form of printed circuit to exhibit discontinuities of structure generating at least one impedance jump and at least one capacitive coupling between its two conducting strips so as to reproduce a quarter wave phase difference.

9. A device for transmitting and/or receiving a wide bandwidth signal, comprising an antenna system that comprises, on a same surface of a dielectric substrate, a first half of a thick radiating dipole, a first conducting strip of a bi-strip line for supplying a differential signal, said first conducting strip being connected to the first half of the thick radiating dipole, a second half of a thick radiating dipole and a second conducting strip of the bi-strip supply line, said second conducting strip being connected to the second half of the thick radiating dipole, wherein said differential dipole antenna system further comprises:

on said same surface an additional conducting strip defining a short circuit connecting the first half and the second half of the thick dipole, and a differential resonating filtering device having a bandwidth adapted so as to be combined with the resonance generated by the short circuit so as to generate an antenna impedance matching.

10. A differential dipole antenna, comprising, on a same surface of a dielectric substrate, a first half of a thick radiating dipole, a first conducting strip of a bi-strip line supplying a differential signal, said first conducting strip being connected to the first half of the thick radiating dipole, a second half of the thick radiating dipole and a second conducting strip of the bi-strip supply line, said second conducting strip being connected to the second half of the thick radiating dipole, wherein said antenna system further comprises on said same surface an additional conducting strip forming a short circuit connecting the first half and the second half of the thick dipole, and wherein said antenna system is configured to be connected to a differential resonating filtering device to form an antenna system.

* * * * *